US010420179B1

(12) United States Patent
Chen et al.

(10) Patent No.: US 10,420,179 B1
(45) Date of Patent: Sep. 17, 2019

(54) DRIVER CIRCUIT SUPPLYING POSITIVE AND NEGATIVE VOLTAGES AND CONTROL CIRCUIT AND CONTROL METHOD THEREOF

(71) Applicant: RICHTEK TECHNOLOGY CORPORATION, Zhubei, Hsinchu (TW)

(72) Inventors: Ching-Yu Chen, Hsinchu (TW); Hsing-Shen Huang, Hsinchu (TW)

(73) Assignee: RICHTEK TECHNOLOGY CORPORATION, Zhubei, Hsinchu (TW)

( * ) Notice: Subject to any disclaimer, the term of this patent is extended or adjusted under 35 U.S.C. 154(b) by 0 days.

(21) Appl. No.: 16/202,184

(22) Filed: Nov. 28, 2018

Related U.S. Application Data

(60) Provisional application No. 62/658,830, filed on Apr. 17, 2018.

(30) Foreign Application Priority Data

Sep. 28, 2018 (CN) ..... 2018 1 1137018

(51) Int. Cl.
*H05B 33/08* (2006.01)
*G05F 1/56* (2006.01)

(52) U.S. Cl.
CPC ..... *H05B 33/0821* (2013.01); *G05F 1/56* (2013.01); *H05B 33/0815* (2013.01)

(58) Field of Classification Search
CPC ..... H05B 33/08; H05B 33/0815; H05B 33/0821; H05B 33/0842; H05B 37/02; H05B 37/0227; H05B 37/0263; H05B 37/0272; G05F 1/56
See application file for complete search history.

(56) References Cited

U.S. PATENT DOCUMENTS 7,843,150 B2 * 11/2010 Wang ..... H05B 33/0815 315/185 R
8,471,499 B2 6/2013 Um et al.
9,075,423 B2 7/2015 Zhu et al.
9,370,064 B2 6/2016 Fensore

* cited by examiner

*Primary Examiner* — Jimmy T Vu
(74) *Attorney, Agent, or Firm* — Tung & Associates

(57) ABSTRACT

A driver circuit supplies a positive voltage and a negative voltage to a load. The driver circuit includes: a positive power conversion circuit, coupled to the load, and generating the positive voltage according to an input voltage; a negative power conversion circuit, coupled to the positive power conversion circuit and the load, and generating the negative voltage according to the positive voltage; and a headroom adaptive adjustment circuit, coupled to the positive power conversion circuit and the load, and generating an adjustment signal according to one or more of a load current flowing through the load, the positive voltage Vp and the negative voltage Vn. The adjustment signal is sent to the positive power conversion circuit to adjust a regulation target of the positive voltage.

20 Claims, 8 Drawing Sheets

DRIVER CIRCUIT SUPPLYING POSITIVE AND NEGATIVE VOLTAGES AND CONTROL CIRCUIT AND CONTROL METHOD THEREOF

CROSS REFERENCE

The present invention claims priority to U.S. 62/658,830, filed on Apr. 17, 2018, and CN 201811137018.0, filed on Sep. 28, 2018.

BACKGROUND OF THE INVENTION

Field of Invention

The present invention relates to a driver circuit supplying positive and negative voltages, and a control circuit and a control method thereof. In particular, the present invention relates to a driver circuit supplying positive and negative voltages, which can adaptively adjust the positive voltage so as to maintain the stability of the negative voltage, and a control circuit and a control method thereof

Description of Related Art

In certain applications, such as for driving a panel display or a loudspeaker, the load requires positive and negative voltages as its power sources, instead of operating between a positive voltage and ground. Referring to FIG. 1, in these applications, usually two power conversion circuits are employed, wherein a positive power conversion circuit 11 generates the positive voltage Vp according to an input voltage Vin, and a negative power conversion circuit 12 generates the negative voltage Vn according to the positive voltage Vp generated by the positive power conversion circuit 11.

The prior art shown in FIG. 1 has a drawback. Referring to FIG. 2, when a load current Iload flowing through the load 13 increases, because the energy generated by the positive power conversion circuit 11 is supplied to the load 13 in higher priority, the negative power conversion circuit 12 may not have enough operation headroom to operate normally and therefore is unable to generate a sufficient negative voltage, that is, the negative voltage Vn will increase, causing the load 13 to operate unstably. When the load 13 is a panel display, the displayed graphics will distort.

Hence, the present invention proposes a driver circuit supplying positive and negative voltages, and a control circuit and a control method thereof, to solve the aforementioned problem.

Prior art patents relevant to the present invention are: U.S. Pat. No. 9,370,064 B2, U.S. Pat. No. 9,075,423 B2, and U.S. Pat. No. 8,471,499 B2.

SUMMARY OF THE INVENTION

From one perspective, the present invention provides a driver circuit configured to operably supply a positive voltage and a negative voltage to a load, the driver circuit comprising: a positive power conversion circuit, coupled to the load, and configured to operably generate the positive voltage according to an input voltage; a negative power conversion circuit, coupled to the positive power conversion circuit and the load, and configured to operably generate the negative voltage according to the positive voltage; and a headroom adaptive adjustment circuit, coupled to the positive power conversion circuit and the load, and configured to operably generate an adjustment signal according to one or more of a load current flowing through the load, the positive voltage and the negative voltage, and sends the adjustment signal to the positive power conversion circuit to adjust a regulation target of the positive voltage.

In one embodiment, the headroom adaptive adjustment circuit compares the negative voltage with a voltage threshold, and generates the adjustment signal according to a result of the comparison.

In one embodiment, the headroom adaptive adjustment circuit compares the load current with at least one current threshold, and generates the adjustment signal according to a result of the comparison.

In one embodiment, the headroom adaptive adjustment circuit includes an analog to digital conversion circuit (ADC), configured to operably convert a sense signal of the load current to a digital signal; and a look-up table circuit, configured to operably generate the adjustment signal in correspondence to an output from the ADC.

In one embodiment, the headroom adaptive adjustment circuit generates the adjustment signal according to a load requirement, to adjust a difference between the positive voltage and an absolute value of the negative voltage, so as to control a change rate of the load current.

In one embodiment, the headroom adaptive adjustment circuit compares a change rate of the load current with at least one slope threshold, and generates the adjustment signal according to a result of the comparison.

From another perspective, the present invention provides a driver circuit configured to operably supply a positive voltage and a negative voltage to a load, the driver circuit comprising: a positive power conversion circuit, coupled to the load, and configured to operably generate the positive voltage according to an input voltage; a negative power conversion circuit, coupled to the positive power conversion circuit and the load, and configured to operably generate the negative voltage according to the positive voltage; a temperature sensing circuit, configured to operably sense a temperature; and a headroom adaptive adjustment circuit, coupled to the temperature sensing circuit and the positive power conversion circuit, and configured to operably generate an adjustment signal according to the temperature sensed by the temperature sensing circuit, and sends the adjustment signal to the positive power conversion circuit to adjust a regulation target of the positive voltage or a difference between the positive voltage and an absolute value of the negative voltage.

From another perspective, the present invention provides a control circuit for controlling a driver circuit, the driver circuit being configured to operably supply a positive voltage and a negative voltage to a load, and the driver circuit including a power stage circuit coupled to the load and configured to operably generate the positive voltage according to an input voltage; and a negative power conversion circuit coupled to the power stage circuit and the load, and configured to operably generate the negative voltage according to the positive voltage; the control circuit comprising: a headroom adaptive adjustment circuit, configured to operably generate an adjustment signal according to one or more of a load current flowing through the load, the positive voltage and the negative voltage; an error amplifier circuit, configured to operably determine a reference voltage according to the adjustment signal, and compare the positive voltage or a signal related to the positive voltage with the reference voltage to generate a comparison result, wherein the reference voltage represents a regulation target of the positive voltage; and a switch control circuit, configured to operably generate at least one switch signal according to the comparison result, to control the power stage circuit to convert the input voltage to the positive voltage.

From another perspective, the present invention provides a control circuit for controlling a driver circuit, the driver circuit being configured to operably supply a positive voltage and a negative voltage to a load, and the driver circuit including a power stage circuit coupled to the load and configured to operably generate the positive voltage according to an input voltage; and a negative power conversion circuit coupled to the power stage circuit and the load, and configured to operably generate the negative voltage according to the positive voltage; the control circuit comprising: a headroom adaptive adjustment circuit, configured to operably generate an adjustment signal according to one or more of a load current flowing through the load, the positive voltage and the negative voltage; a subtractor circuit, configured to operably obtain a difference between the positive voltage and an absolute value of the negative voltage, or a difference between a signal related to the positive voltage and an absolute value of a signal related to the negative voltage; an error amplifier circuit, configured to operably determine a reference voltage according to the adjustment signal, and compare the difference with the reference voltage to generate a comparison result, wherein the reference voltage represents a regulation target of the positive voltage; and a switch control circuit, configured to operably generate at least one switch signal according to the comparison result, to control the power stage circuit to convert the input voltage to the positive voltage.

From another perspective, the present invention provides a control method for controlling a driver circuit, the driver circuit being configured to operably supply a positive voltage and a negative voltage to a load, the driver circuit comprising a positive power conversion circuit coupled to the load and configured to operably generate the positive voltage according to an input voltage, and a negative power conversion circuit coupled to the positive power conversion circuit and the load, and configured to operably generate the negative voltage according to the positive voltage; the control method comprising: generating an adjustment signal according to one or more of a load current flowing through the load, the positive voltage and the negative voltage; and sending the adjustment signal to the positive power conversion circuit to adjust a regulation target of the positive voltage.

The objectives, technical details, features, and effects of the present invention will be better understood with regard to the detailed description of the embodiments below.

DESCRIPTION OF THE PREFERRED EMBODIMENTS

The drawings as referred to throughout the description of the present invention are for illustration only, to show the interrelations between the circuits and the signal waveforms, but not drawn according to actual scale.

Figure 1:
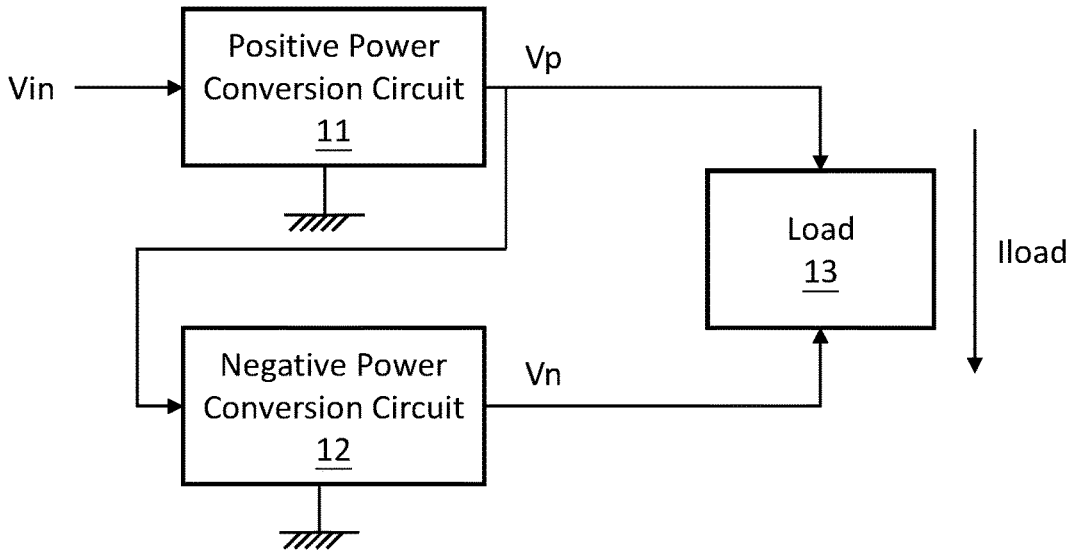
Fig. 1 (Prior Art)
FIG. 1 shows a schematic diagram of a prior art driver circuit supplying positive and negative voltages.
Figure 2:
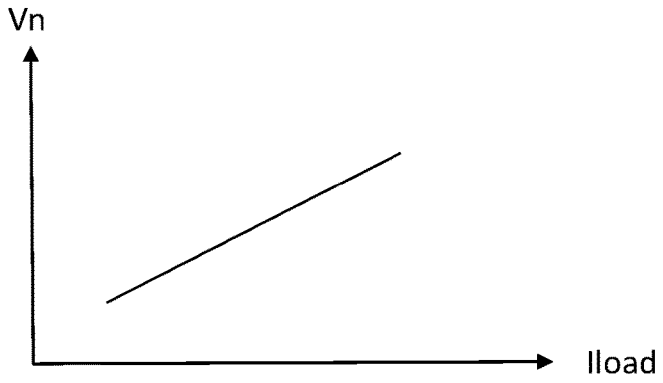
Fig. 2 (Prior Art)
FIG. 2 shows that the negative voltage Vn will be adversely affected by the increase of the load current Iload.
Figure 3:
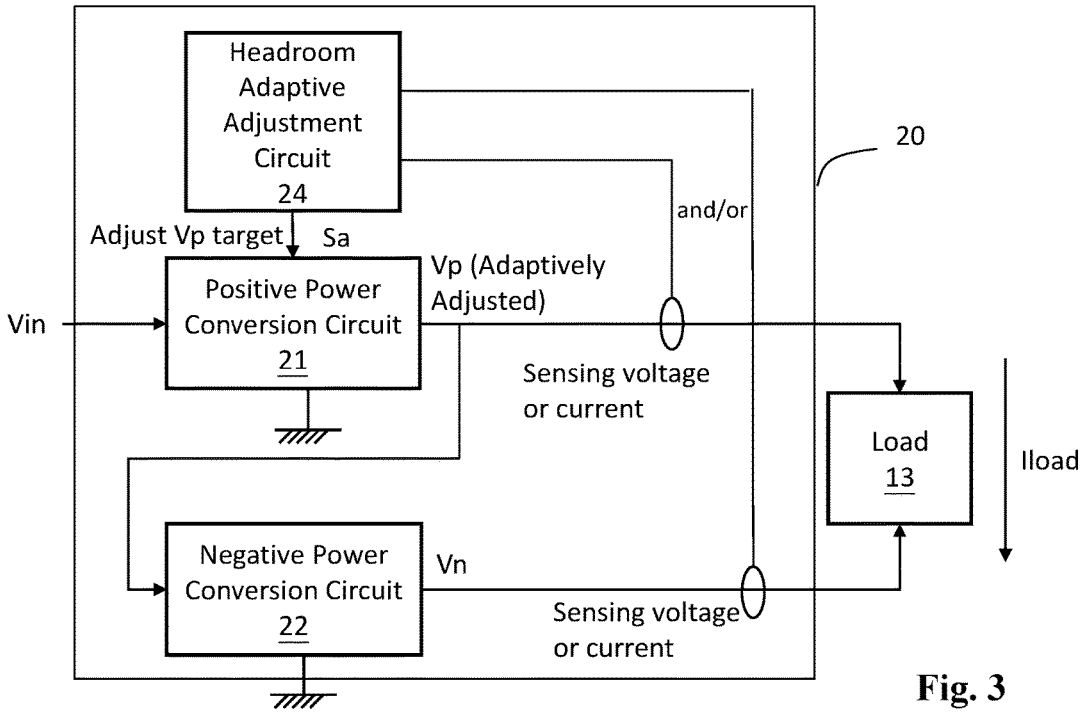
FIG. 3 shows an embodiment of the present invention.

FIG. 3 shows an embodiment of a driver circuit supplying positive and negative voltages according to the present invention (driver circuit 20). The driver circuit 20 includes a positive power conversion circuit 21, a negative power conversion circuit 22, and a headroom adaptive adjustment circuit 24. The positive power conversion circuit 21 generates the positive voltage Vp according to an input voltage Vin, and the negative power conversion circuit 22 generates the negative voltage Vn according to the positive voltage Vp generated by the positive power conversion circuit 21, to supply positive and negative voltages to a load 13. The headroom adaptive adjustment circuit 24 generates an adjustment signal Sa according to the load current Iload, the positive voltage Vp and/or the negative voltage Vn (i.e., according to one or more of the load current Iload, the positive voltage Vp and the negative voltage Vn), and sends the adjustment signal Sa to the positive power conversion circuit 21 to adjust the regulation target of the positive voltage Vp. When the positive voltage Vp changes, the difference between the positive and negative operation voltages of the load 13 (i.e. the headroom of the load 13) changes accordingly, so the circuit 24 is named "headroom adaptive adjustment circuit". Detail embodiments as to how the headroom adaptive adjustment circuit 24 generates the adjustment signal Sa according to one or more of the load current Iload, the positive voltage Vp and the negative voltage Vn to adjust the regulation target of the positive voltage Vp will be described later.

Figure 4:
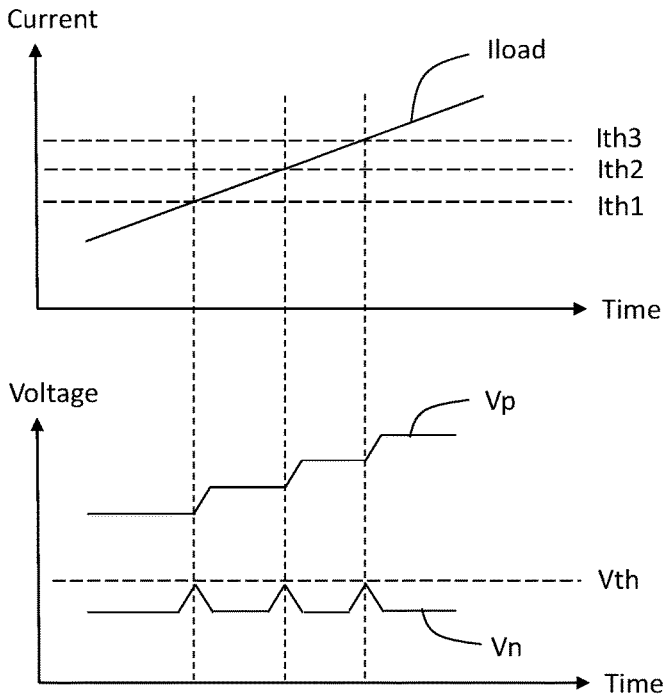
FIG. 4 shows that when the load current Iload varies, the present invention adjusts the positive voltage Vp according to current or voltage, to maintain the negative voltage Vn stable.
Figure 5:
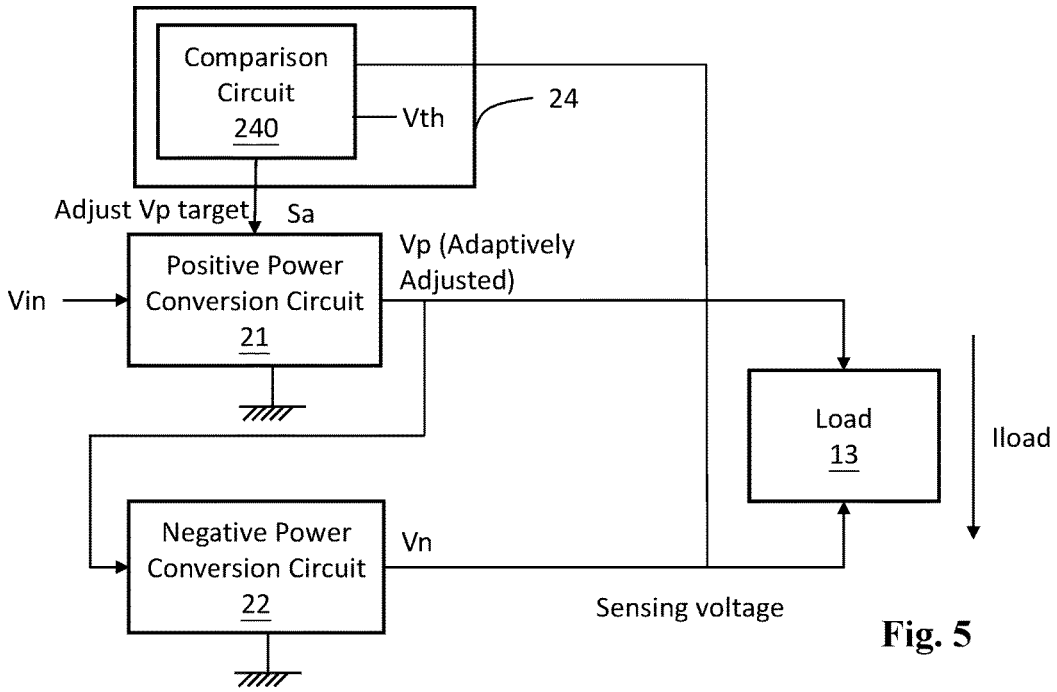
FIG. 5 shows an embodiment wherein the present invention adjusts the positive voltage Vp according to the negative voltage Vn, to maintain the negative voltage Vn stable.

Please refer to FIG. 4. One application of the present invention is that, when the load current Iload varies, the present invention adjusts the positive voltage Vp according to current or voltage, to maintain the negative voltage Vn stable. This application can be embodied in many ways. In one embodiment, the headroom adaptive adjustment circuit 24 senses the negative voltage Vn; when the negative voltage Vn increases, it indicates that the headroom of the load 13 is not sufficient, and the positive voltage Vp should be increased accordingly, so the headroom adaptive adjustment circuit 24 raises the regulation target of the positive voltage Vp. Referring to FIGS. 4 and 5, in one embodiment, the headroom adaptive adjustment circuit 24 includes a comparison circuit 240, which is configured to operably compare the negative voltage Vn with a voltage threshold Vth; when the negative voltage Vn reaches or is higher than the voltage threshold Vth, the headroom adaptive adjustment circuit 24 raises the regulation target of the positive voltage Vp. When the positive voltage Vp increases, the power supply capability is increased, so the driver circuit 20 can, besides supplying sufficient power to the load 13, let the negative power conversion circuit 22 generate the negative voltage Vn as low as required, whereby the negative voltage Vn can be maintained stable.

Figure 6:
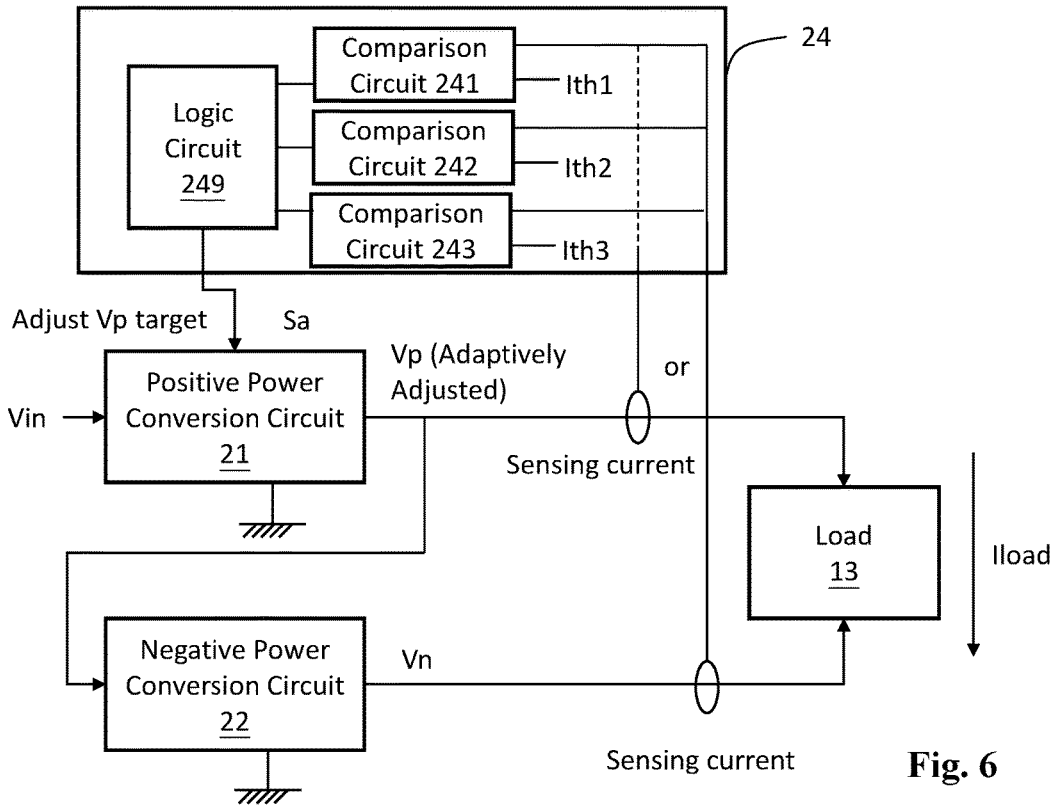
FIG. 6 shows an embodiment wherein the present invention adjusts the positive voltage Vp according to the load current Iload, to maintain the negative voltage Vn stable.

Referring to FIGS. 4 and 6, in another embodiment, the headroom adaptive adjustment circuit 24 senses the load current Iload; when the load current Iload increases, the headroom adaptive adjustment circuit 24 raises the regulation target of the positive voltage Vp. In the embodiment of FIG. 6, the headroom adaptive adjustment circuit 24 includes comparison circuits 241-243, which are respectively configured to operably compare the load current Iload with current thresholds Ith-Ith3; a logic circuit 249 receives the comparison results from the comparison circuits 241-243 and performs a logic operation on them. Thus, the regulation target of the positive voltage Vp can be adjusted according to the increase (or decrease) of the load current Iload. Similar to the previous embodiment, when the positive voltage Vp increases, the power supply capability is increased, so the driver circuit 20 can, besides supplying sufficient power to the load 13, let the negative power conversion circuit 22 generate the negative voltage Vn as low as required, whereby the negative voltage Vn can be maintained stable.

Figure 7:
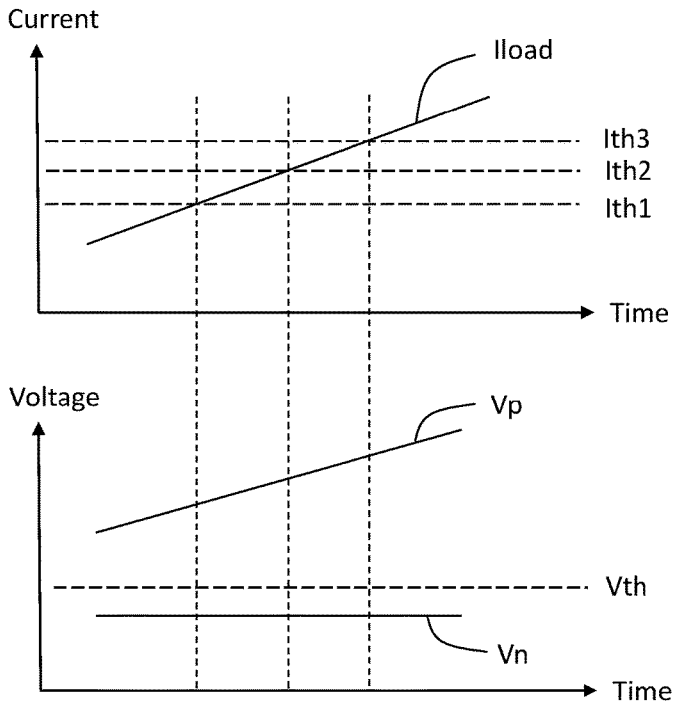
FIGS. 7-8 show another embodiment wherein the present invention adjusts the positive voltage Vp according to the load current Iload, to maintain the negative voltage Vn stable.
Figure 8:
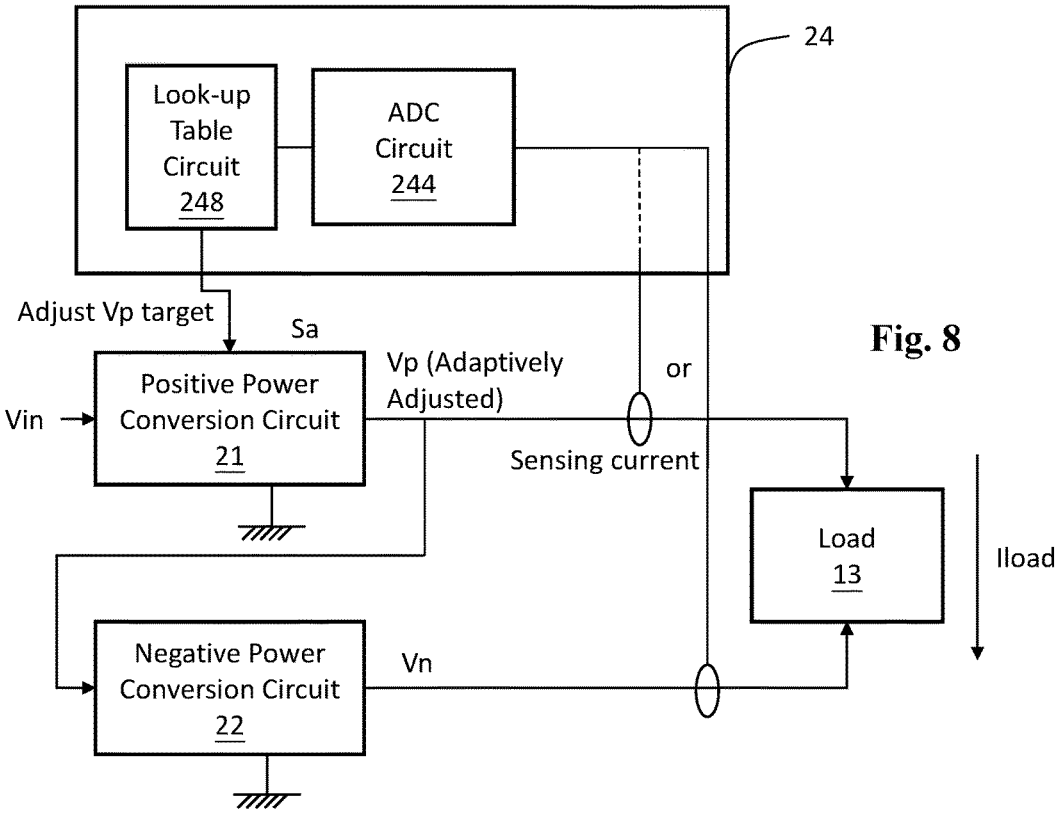

In the embodiments of FIGS. 4-6, the positive voltage Vp is adjusted step-wisely, but the present invention is not limited to this arrangement; in another embodiment, the positive voltage Vp can be adjusted continuously. For example, referring to FIGS. 7-8, in the embodiment shown in FIG. 8, the headroom adaptive adjustment circuit 24 includes an analog-to-digital conversion circuit (ADC) 244, which converts a current sense signal regarding the load current Iload to a digital signal, and a look-up table circuit 248 generates an output in correspondence with the output from the ADC 244, to adjust the regulation target of the positive voltage Vp accordingly. Similar to the previous embodiments, when the positive voltage Vp increases, the power supply capability is increased, so the driver circuit 20 can, besides supplying sufficient power to the load 13, let the negative power conversion circuit 22 generate the negative voltage Vn as low as required, whereby the negative voltage Vn can be maintained stable.

Figure 9:
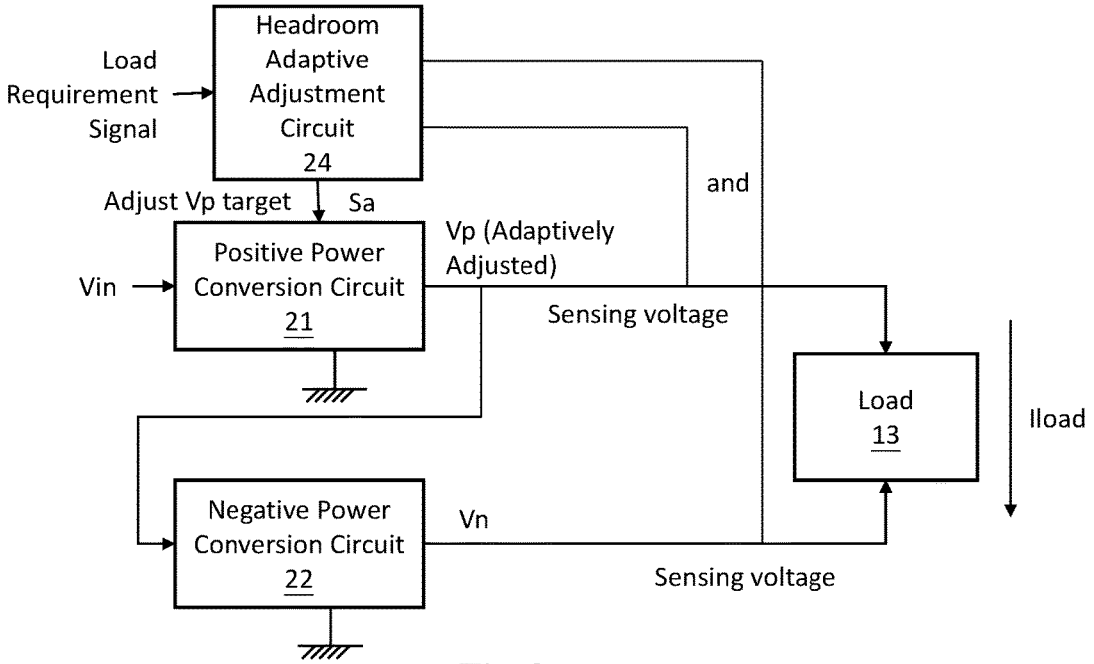
FIGS. 9-10 show an embodiment wherein the present invention adjusts the positive voltage Vp according to a difference between the positive voltage Vp and the negative voltage Vn, to adjust the slope of the load current Iload.
Figure 10:
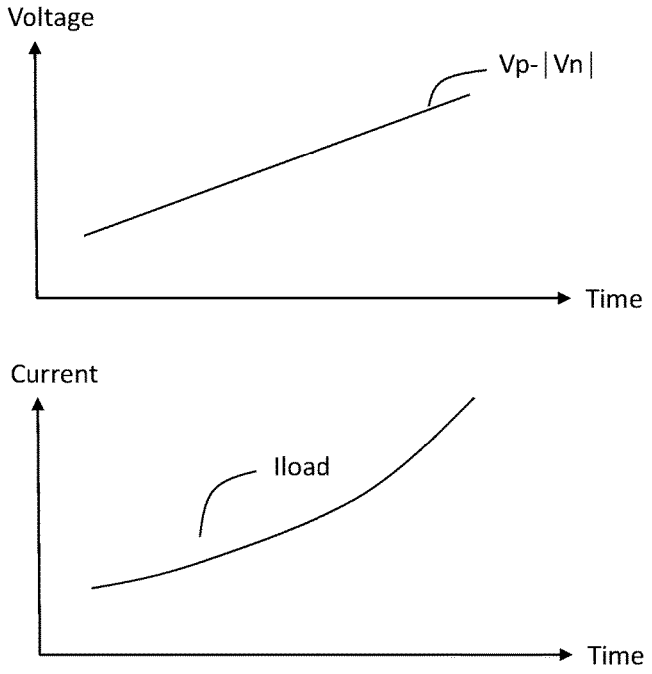

Please refer to FIGS. 9-10. Another application of the present invention is to control the load current Iload so that it changes according to a predetermined slope of. In the previous embodiments, the present invention adjusts the positive voltage Vp to maintain the negative voltage Vn stable. In the embodiment of FIGS. 9-10, the present invention proactively adjusts the head room of the load 13, so as to adjust the load current Iload. Referring to the figures, the headroom adaptive adjustment circuit 24 receives a load requirement signal (e.g. from the load 13); when the load requirement signal requests to increase the load current Iload, the headroom adaptive adjustment circuit 24 raises the regulation target of the positive voltage Vp, so as to increase the voltage difference between the positive voltage Vp and the negative voltage Vn, and accordingly adjust the load current Iload thereby. The predetermined slope of the load current Iload can be linear or non-linear (the latter is shown in the figure.

Figure 11:
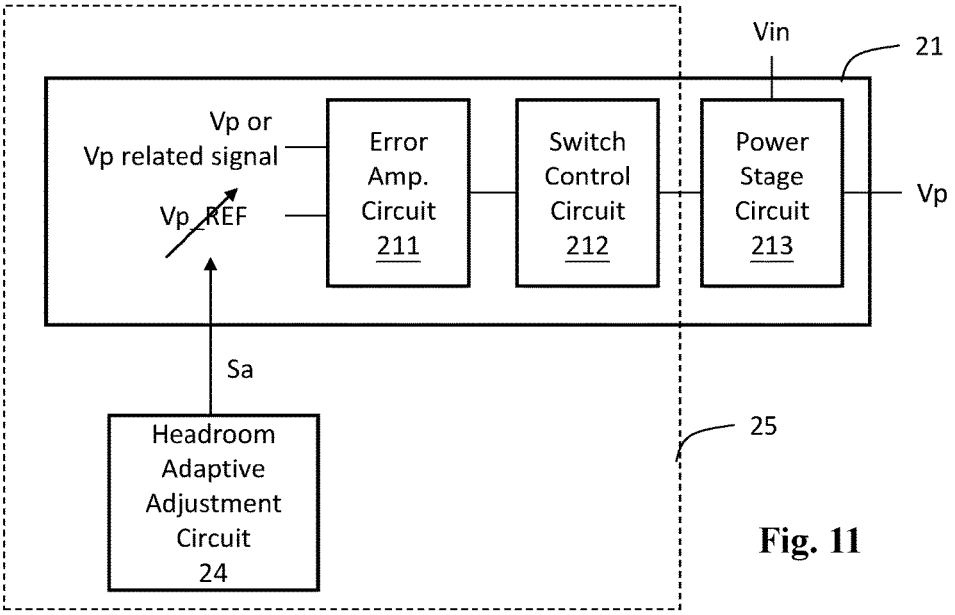
FIG. 11 shows an embodiment of a positive power conversion circuit 21 corresponding to the embodiments of FIGS. 4-8.

FIG. 11 shows an embodiment of a positive power conversion circuit 21 corresponding to the embodiments of FIGS. 4-8. The positive power conversion circuit 21 includes an error amplifier circuit 211, a switch control circuit 212, and a power stage circuit 213. The power stage circuit 213 for example may be a switching power conversion circuit including one or more power switches and an inductor, or a capacitive power conversion circuit (such as a charge pump) including one or more power switches and one or more capacitors. The error amplifier circuit 211 compares the positive voltage Vp or a signal related to the positive voltage Vp (Vp related signal, such as a divided voltage of the positive voltage Vp) with a reference voltage Vp_REF to output an error amplified signal, wherein the reference voltage Vp_REF represents the regulation target of the positive voltage Vp. The switch control circuit 212 generate switch control signals according to the output from the error amplifier circuit 211, to control the power switch(es) in the power stage circuit 213, so as to convert the input voltage Vin to the positive voltage Vp. As such, the circuitry forms a feedback loop which regulates the positive voltage Vp in correspondence to the reference voltage Vp_REF, i.e., to regulate the positive voltage Vp to its regulation target. When the adjustment signal Sa from the headroom adaptive adjustment circuit 24 adjusts the reference voltage Vp_REF, it adjusts the regulation target of the positive voltage Vp, and the positive voltage Vp generated by the power stage circuit 213 changes correspondingly.

Figure 12:
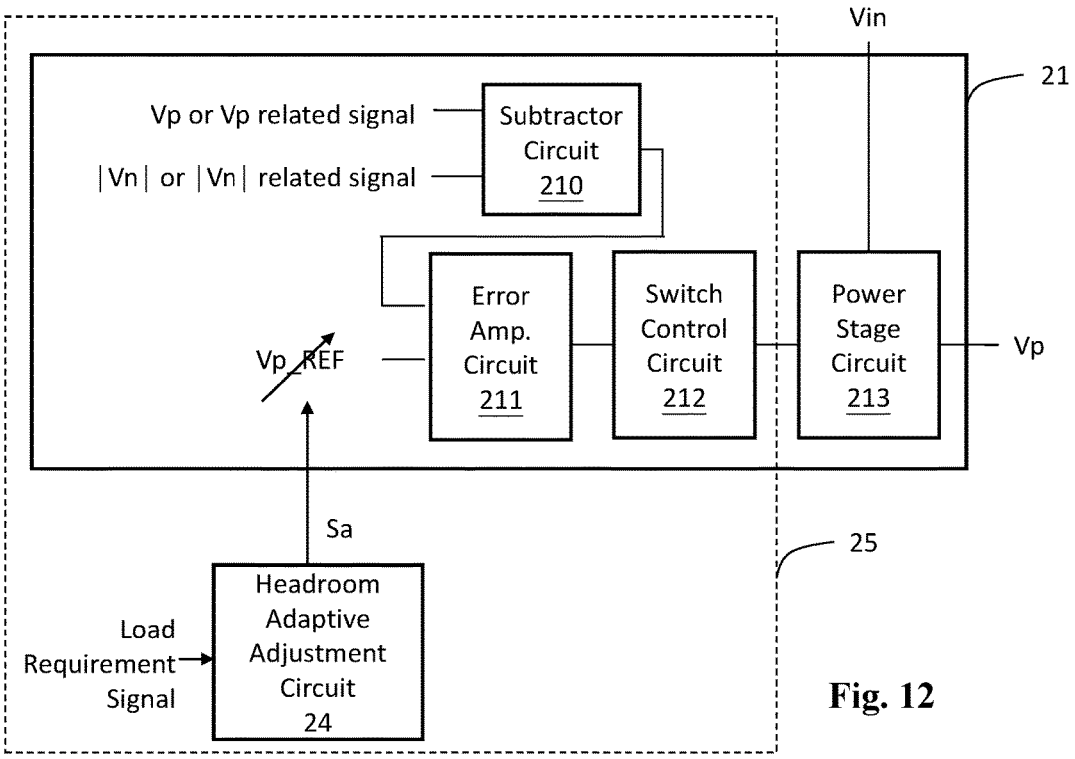
FIG. 12 shows an embodiment of a positive power conversion circuit 21 corresponding to the embodiment of FIGS. 9-10.

FIG. 12 shows an embodiment of a positive power conversion circuit 21 corresponding to the embodiment of FIGS. 9-10. In this embodiment, the positive power conversion circuit 21 includes a subtractor circuit 210, an error amplifier circuit 211, a switch control circuit 212, and a power stage circuit 213. Similar to the previous embodiment, the power stage circuit 213 for example may be a switching power conversion circuit including one or more power switches and an inductor, or a capacitive power conversion circuit (such as a charge pump) including one or more power switches and one or more capacitors. The subtractor circuit 210 obtains a difference between the positive voltage Vp or a signal related to the positive voltage Vp (Vp related signal, such as a divided voltage of the positive voltage Vp) and an absolute value of the negative voltage Vn or a signal related to the negative voltage Vn (Vn related signal, such as a divided voltage of the negative voltage Vn). The error amplifier circuit 211 compares the difference with a reference voltage Vp_REF to output an error amplified signal, wherein the reference voltage Vp_REF represents the regulation target of the difference between the positive voltage Vp and the absolute value of the negative voltage Vn. The switch control circuit 212 generate switch control signals according to the output from the error amplifier circuit 211, to control the power switch (es) in the power stage circuit 213, so as to convert the input voltage Vin to the positive voltage Vp. As such, the circuitry forms a feedback loop which regulates the positive voltage Vp in correspondence to the reference voltage Vp_REF, i.e., to regulate the positive voltage Vp so that the difference between the positive voltage Vp and the absolute value of the negative voltage Vn corresponds to the reference voltage Vp_REF. When the adjustment signal Sa from the headroom adaptive adjustment circuit 24 adjusts the reference voltage Vp_REF, it adjusts the regulation target of the positive voltage Vp, and the positive voltage Vp generated by the power stage circuit 213 changes correspondingly.

In the embodiments of FIGS. 11-12, in one embodiment, the circuits other than the power stage circuit 213 are integrated into a control IC chip 25. In another embodiment, the subtractor circuit 210 may be regarded as a part of the headroom adaptive adjustment circuit 24 instead of apart of the positive power conversion circuit 21, wherein the headroom adaptive adjustment circuit 24 receives the positive voltage Vp and the negative voltage Vn (or the Vp related signal and the Vn related signal), obtains a difference therebetween, and sends the difference to the error amplifier circuit 211 in the positive power conversion circuit 21.

Figure 13:
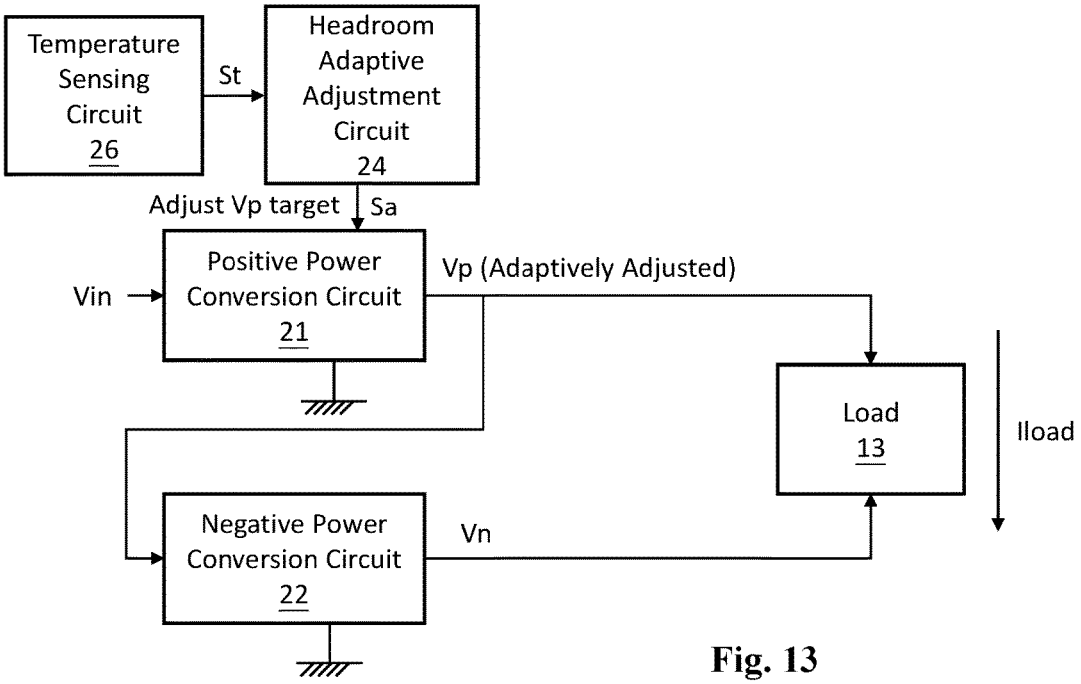
FIG. 13 shows another embodiment wherein the present invention adjusts the positive voltage Vp according to temperature.
Figure 14:
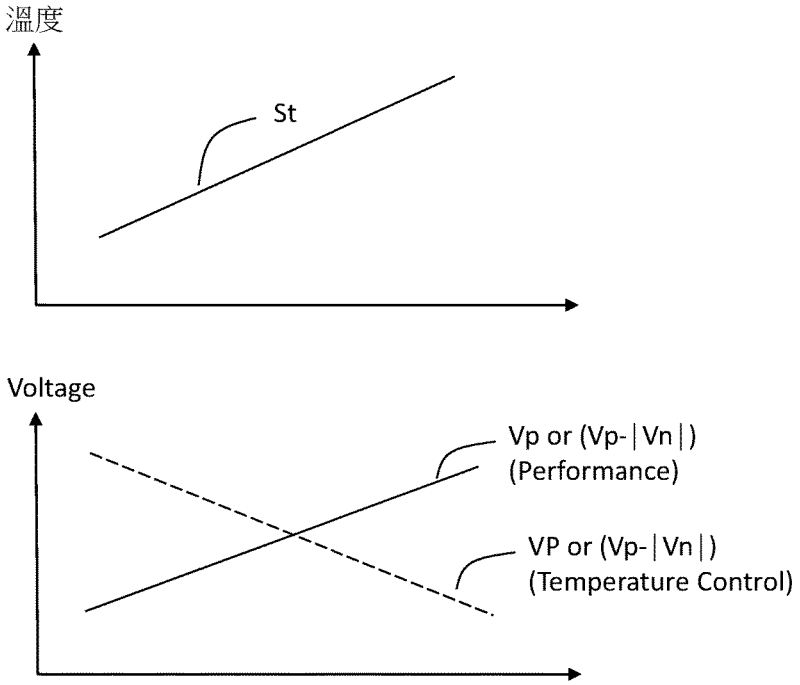
FIG. 14 shows that, when adjusting the positive voltage Vp according to temperature, the goal can be focused on performance or temperature control.

FIGS. 13-14 show another embodiment wherein the present invention adjusts the positive voltage Vp according to temperature. Referring to FIG. 13, a temperature sensing circuit 26 senses temperature to generate a temperature sense signal St; the headroom adaptive adjustment circuit 24 receives the temperature sense signal St, and generates the adjustment signal Sa according to the temperature sense signal St, to adjust the regulation target of the positive voltage Vp accordingly. Referring to FIG. 14, the adjustment can be designed differently depending on different objectives. For example, if high temperature is a concern, the positive voltage Vp can be adjusted lower (or the difference between the positive voltage Vp and the absolute value of the negative voltage Vn can be adjusted lower) as the temperature increases; when the positive voltage Vp is lowered or when the difference between the positive voltage Vp and the absolute value of the negative voltage Vn is lowered, the power consumption is lowered and the temperature can be lowered. For another example, if high temperature is not a concern, but high temperature adversely affects the performance of the circuitry, then the positive voltage Vp can be adjusted higher (or the difference between the positive voltage Vp and the absolute value of the negative voltage Vn can be adjusted higher) as the temperature increases; when the positive voltage Vp becomes higher or when the difference between the positive voltage Vp and the absolute value of the negative voltage Vn becomes higher, the power supplied to the load becomes higher, and the performance can be better.

The hardware to generate the adjustment signal Sa according to the temperature sense signal St, can be embodied in many ways. For example, one skilled in this art can refer to FIGS. 5, 6 and 8, and replace the sensed voltage or the sensed current by the temperature sense signal St. More specifically, the temperature sense signal St can be compared with a reference value, and the adjustment signal Sa can be generated according to the comparison result; or, an ADC can be used to convert the temperature sense signal St into a digital signal, and a look-up table generates an output in correspondence to the digital signal, which is the adjustment signal Sa.

Figure 15:
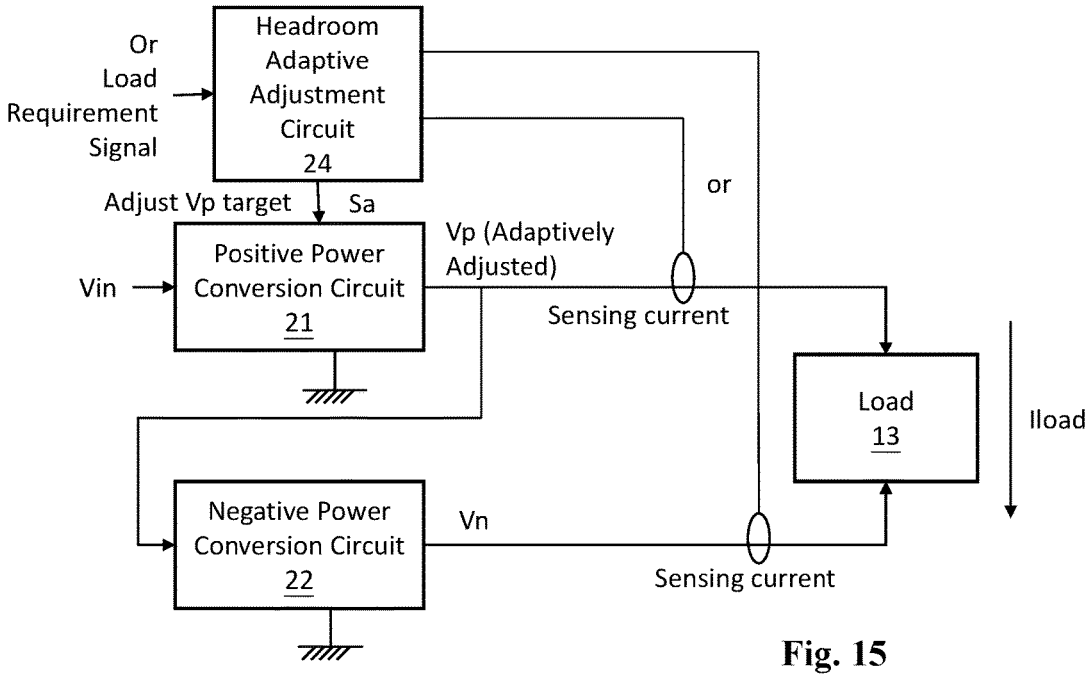
FIGS. 15-16 show another embodiment wherein the present invention adjusts the positive voltage Vp according to a change of the load current Iload, so that the change rate (slope) of the positive voltage Vp is changed in correspondence to a different change rate (slope) of the load current Iload.
Figure 16:
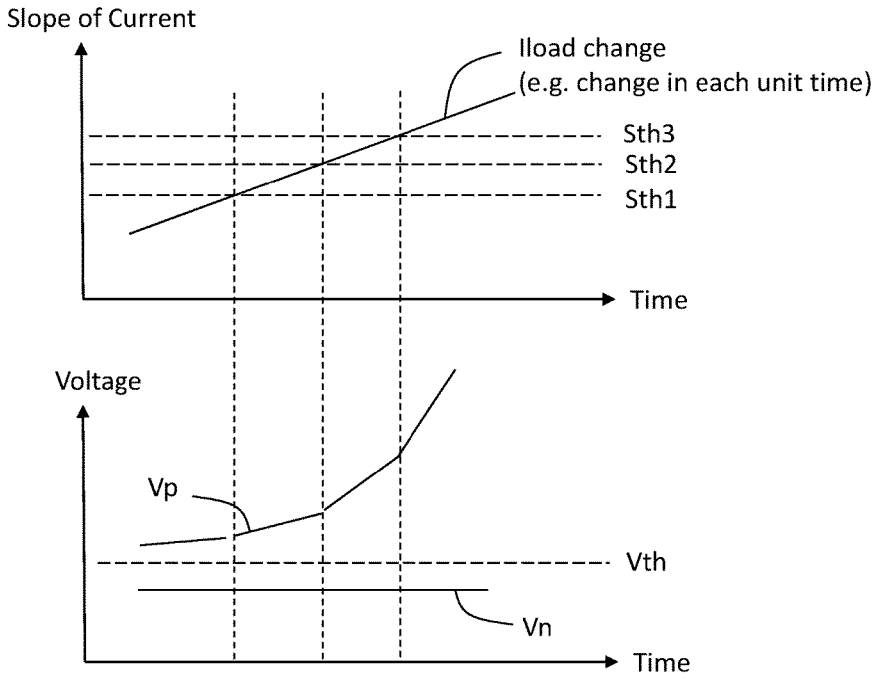

FIGS. 15-16 show another embodiment wherein the present invention adjusts the positive voltage Vp according to a change of the load current Iload, so that the change rate (slope) of the positive voltage Vp is changed in correspondence to a different change rate (slope) of the load current Iload. In the embodiment of FIGS. 15-16, when the headroom adaptive adjustment circuit 24 receives a load requirement signal or when the headroom adaptive adjustment circuit 24 senses a different change rate (slope) of the load current Iload, the headroom adaptive adjustment circuit 24 raises the regulation target of the positive voltage Vp by a corresponding different slope, to increase the difference between the positive voltage Vp and the negative voltage Vn, so as to suppress the instability caused by the fast variation of the load current Iload. The slope of the positive voltage Vp can be controlled to be non-linear or linear in each segment, the latter being shown in the figure.

To embody, the headroom adaptive adjustment circuit 24 can obtain a difference between the currently sensed load current Iload and the previously sensed load current Iload, and compare the difference with a predetermined slope threshold. When the change of the load current Iload in a unit time is larger than the predetermined slope threshold, the headroom adaptive adjustment circuit 24 sends the adjustment signal Sa to the positive power conversion circuit 21 to adjust the regulation target of the positive voltage Vp. There can be only one predetermined slope threshold, or multiple predetermined slope thresholds, such as Sth1-Sth3 in FIG. 16.

The present invention has been described in considerable detail with reference to certain preferred embodiments thereof. It should be understood that the description is for illustrative purpose, not for limiting the scope of the present invention. It is not limited for each of the embodiments described hereinbefore to be used alone; under the spirit of the present invention, two or more of the embodiments described hereinbefore can be used in combination. That is, two or more of the embodiments can be used together, or, a part of one embodiment can be used to replace a corresponding part of another embodiment. For example, the driver circuit can adjust the positive voltage Vp not only according to the sensed voltage and/or sensed current, but also according to the sensed temperature. For another example, the driver circuit can control the change rate of the load current Iload, and concurrently adjust the positive voltage Vp according to the sensed temperature. In addition, under the spirit of the present invention, those skilled in this art can readily conceive variations and modifications within the spirit of the present invention. For example, a circuit or a component can be inserted between two circuits or components shown to be in direct connection in the embodiments, as long as the inserted circuit or component does not affect the primary function of the circuitry, such as a switch, a divider circuit, a sampling circuit, a level shifter circuit, etc. In addition, to perform an action "according to" a certain signal as described in the context of the present invention is not limited to performing an action strictly according to the signal itself, but can be performing an action according to a converted form or a scaled-up or down form of the signal, i.e., the signal can be processed by a voltage-to-current conversion, a current-to-voltage conversion, and/or a ratio conversion, etc. before an action is performed. And, a comparison circuit can be embodied as a comparator circuit or an operational amplifier circuit, as required. Therefore, the spirit of the present invention should cover all the above and other modifications and variations, which should be interpreted to fall within the scope of the following claims and their equivalents.

What is claimed is:

1. A driver circuit configured to operably supply a positive voltage and a negative voltage to a load, the driver circuit comprising:

a positive power conversion circuit, coupled to the load, and configured to operably generate the positive voltage according to an input voltage;

a negative power conversion circuit, coupled to the positive power conversion circuit and the load, and configured to operably generate the negative voltage according to the positive voltage; and a headroom adaptive adjustment circuit, coupled to the positive power conversion circuit and the load, and configured to operably generate an adjustment signal according to one or more of a load current flowing through the load, the positive voltage and the negative voltage, and sends the adjustment signal to the positive power conversion circuit to adjust a regulation target of the positive voltage.

2. The driver circuit according to claim 1, wherein the headroom adaptive adjustment circuit compares the negative voltage with a voltage threshold, and generates the adjustment signal according to a result of the comparison.

3. The driver circuit according to claim 1, wherein the headroom adaptive adjustment circuit compares the load current with at least one current threshold, and generates the adjustment signal according to a result of the comparison.

4. The driver circuit according to claim 1, wherein the headroom adaptive adjustment circuit includes an analog to digital conversion circuit (ADC), configured to operably convert a sense signal of the load current to a digital signal; and a look-up table circuit, configured to operably generate the adjustment signal in correspondence to the digital signal outputted from the ADC.

5. The driver circuit according to claim 1, wherein the headroom adaptive adjustment circuit generates the adjustment signal according to a load requirement, to adjust a difference between the positive voltage and an absolute value of the negative voltage, so as to control a change rate of the load current.

6. The driver circuit according to claim 1, wherein the headroom adaptive adjustment circuit compares a change rate of the load current with at least one slope threshold, and generates the adjustment signal according to a result of the comparison.

7. A driver circuit configured to operably supply a positive voltage and a negative voltage to a load, the driver circuit comprising:

a positive power conversion circuit, coupled to the load, and configured to operably generate the positive voltage according to an input voltage;

a negative power conversion circuit, coupled to the positive power conversion circuit and the load, and configured to operably generate the negative voltage according to the positive voltage;

a temperature sensing circuit, configured to operably sense a temperature; and a headroom adaptive adjustment circuit, coupled to the temperature sensing circuit and the positive power conversion circuit, and configured to operably generate an adjustment signal according to the temperature sensed by the temperature sensing circuit, and sends the adjustment signal to the positive power conversion circuit to adjust a regulation target of the positive voltage or a difference between the positive voltage and an absolute value of the negative voltage.

8. A control circuit for controlling a driver circuit, the driver circuit being configured to operably supply a positive voltage and a negative voltage to a load, and the driver circuit including a power stage circuit coupled to the load and configured to operably generate the positive voltage according to an input voltage; and a negative power conversion circuit coupled to the power stage circuit and the load, and configured to operably generate the negative voltage according to the positive voltage; the control circuit comprising:

a headroom adaptive adjustment circuit, configured to operably generate an adjustment signal according to one or more of a load current flowing through the load, the positive voltage and the negative voltage;

an error amplifier circuit, configured to operably determine a reference voltage according to the adjustment signal, and compare the positive voltage or a signal related to the positive voltage with the reference voltage to generate a comparison result, wherein the reference voltage represents a regulation target of the positive voltage; and a switch control circuit, configured to operably generate at least one switch signal according to the comparison result, to control the power stage circuit to convert the input voltage to the positive voltage.

9. The control circuit according to claim 8, wherein the headroom adaptive adjustment circuit compares the negative voltage with a voltage threshold, and generates the adjustment signal according to a result of the comparison.

10. The control circuit according to claim 8, wherein the headroom adaptive adjustment circuit compares the load current with at least one current threshold, and generates the adjustment signal according to a result of the comparison.

11. The control circuit according to claim 8, wherein the headroom adaptive adjustment circuit compares a change rate of the load current with at least one slope threshold, and generates the adjustment signal according to a result of the comparison.

12. The control circuit according to claim 8, wherein the headroom adaptive adjustment circuit includes an analog to digital conversion circuit (ADC), configured to operably convert a sense signal of the load current to a digital signal; and a look-up table circuit, configured to operably generate the adjustment signal in correspondence to an output from the ADC.

13. A control circuit for controlling a driver circuit, the driver circuit being configured to operably supply a positive voltage and a negative voltage to a load, and the driver circuit including a power stage circuit coupled to the load and configured to operably generate the positive voltage according to an input voltage; and a negative power conversion circuit coupled to the power stage circuit and the load, and configured to operably generate the negative voltage according to the positive voltage; the control circuit comprising:

a headroom adaptive adjustment circuit, configured to operably generate an adjustment signal according to one or more of a load current flowing through the load, the positive voltage and the negative voltage;

a subtractor circuit, configured to operably obtain a difference between the positive voltage and an absolute value of the negative voltage, or a difference between a signal related to the positive voltage and an absolute value of a signal related to the negative voltage;

an error amplifier circuit, configured to operably determine a reference voltage according to the adjustment signal, and compare the difference with the reference voltage to generate a comparison result, wherein the reference voltage represents a regulation target of the positive voltage; and a switch control circuit, configured to operably generate at least one switch signal according to the comparison result, to control the power stage circuit to convert the input voltage to the positive voltage.

14. The control circuit according to claim 13, wherein the headroom adaptive adjustment circuit generates the adjustment signal according to a load requirement, to adjust the difference so as to control a change rate of the load current.

15. A control method for controlling a driver circuit, the driver circuit being configured to operably supply a positive voltage and a negative voltage to a load, the driver circuit comprising a positive power conversion circuit coupled to the load and configured to operably generate the positive voltage according to an input voltage, and a negative power conversion circuit coupled to the positive power conversion circuit and the load, and configured to operably generate the negative voltage according to the positive voltage; the control method comprising:

generating an adjustment signal according to one or more of a load current flowing through the load, the positive voltage and the negative voltage; and sending the adjustment signal to the positive power conversion circuit to adjust a regulation target of the positive voltage.

16. The control method according to claim 15, wherein the step of generating the adjustment signal includes: comparing the negative voltage with a voltage threshold, and generating the adjustment signal according to a result of the comparison.

17. The control method according to claim 15, wherein the step of generating the adjustment signal includes: comparing the load current with at least one current threshold, and generating the adjustment signal according to a result of the comparison.

18. The control method according to claim 15, wherein the step of generating the adjustment signal includes: comparing a change rate of the load current with at least one slope threshold, and generating the adjustment signal according to a result of the comparison.

19. The control method according to claim 15, wherein the step of generating the adjustment signal includes:

converting a sense signal of the load current to a digital signal; and looking up a look-up table to generate the adjustment signal in correspondence to the digital signal.

20. The control method according to claim 15, wherein the step of generating the adjustment signal includes: generating the adjustment signal according to a load requirement, to adjust a difference between the positive voltage and an absolute value of the negative voltage, so as to control a change rate of the load current.

* * * * *